United States Patent [19]

Boulton et al.

[11] Patent Number: 4,746,415

[45] Date of Patent: May 24, 1988

[54] ELECTRODE

[75] Inventors: Thomas W. Boulton; Brian J. Darwent, both of Frodsham, England

[73] Assignee: Imperial Chemical Industries PLC, London, England

[21] Appl. No.: 936,910

[22] Filed: Dec. 2, 1986

[30] Foreign Application Priority Data

Dec. 16, 1985 [GB] United Kingdom ..... 8530893

[51] Int. Cl.[4] ..... C25B 9/00; C25B 9/04; C25B 11/03; C25B 11/10

[52] U.S. Cl. ..... 204/253; 204/254; 204/279; 204/284; 204/286; 204/290 R; 204/290 F

[58] Field of Search ..... 204/253, 254, 279, 284, 204/286, 280, 290 R, 290 F, 268

[56] References Cited

U.S. PATENT DOCUMENTS

| | | | |
|---|---|---|---|
| 3,600,230 | 8/1971 | Stachurski et al. | 429/27 |
| 3,755,108 | 8/1973 | Raetzsch et al. | 204/98 |
| 3,824,173 | 7/1974 | Bouy et al. | 204/286 X |
| 3,849,279 | 11/1974 | Barkel | 204/286 X |
| 3,859,197 | 1/1975 | Bouy et al. | 204/254 X |
| 3,873,437 | 3/1975 | Pulver | 204/286 X |
| 3,950,239 | 4/1976 | Figueras | 204/284 X |
| 4,085,027 | 4/1978 | Poush et al. | 204/286 X |
| 4,141,801 | 2/1979 | Perry | 204/2.1 |
| 4,350,608 | 9/1982 | Gestaut | 252/425.3 |
| 4,464,242 | 8/1984 | Boulton | 204/288 X |

FOREIGN PATENT DOCUMENTS

| | | |
|---|---|---|
| 0002268 | 5/1979 | European Pat. Off. . |
| 1536290 | 6/1967 | France . |
| 1503799 | 3/1978 | United Kingdom . |
| 2039954A | 8/1980 | United Kingdom . |

*Primary Examiner*—Donald R. Valentine
*Attorney, Agent, or Firm*—Cushman, Darby & Cushman

[57] ABSTRACT

An electrode which comprises a wall of plastics material, an electrically-conductive electrode surface on one side of the wall and displaced therefrom, an electrically-conductive electrode surface on the opposite side of the wall and displaced therefrom, at least one electrically-conductive connecting member in electrical contact with one of the electrode surfaces, at least one electrically-conductive connecting member in electrical contact with the other of the electrode surfaces, and in which the electrically-conductive connecting members are embedded in the wall of plastics material and are in electrical contact with each other.

Also, an electrolytic cell comprising a plurality of said electrodes.

25 Claims, 4 Drawing Sheets

ELECTRODE

Figure 1:
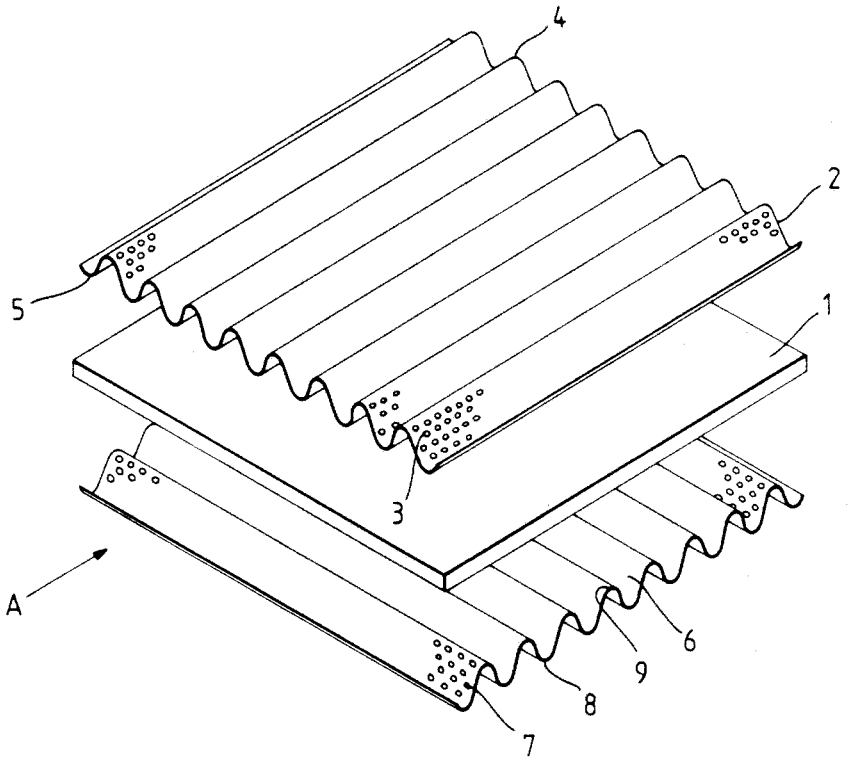

This invention relates to an electrode for use in an electrolytic cell, and in particular to a bipolar electrode for use in an electrolytic cell, although the invention is not limited to such bipolar electrodes.

Monopolar electrodes for use in electrolytic cells may take a variety of forms. Thus, the electrode may consist of a single metal plate, which may be perforated, for example a punched plate, or it may consist of a metallic mesh, which may be woven or unwoven, or it may be a sheet of expanded metal. The electrode may consist of a pair of such plates, meshes or sheets which are spaced apart and which provide a pair of spaced apart outwardly-facing active electrode suffaces, and the active electrode surfaces may have a coating of an electroconducting electro-catalytically-active material. An electrode of this latter type provides a space for liquors in the electrode compartments of the cell, particularly when the active electrode surfaces are close to or in contact with a separator, that is with a hydraulically permeable diaphragm or a hydraulically impermeable ion-exchange membrane positioned between an anode and an adjacent cathode. The monopolar electrode must be provided with means for feeding electrical current to the electrode.

A bipolar electrode for use in an electrolytic cell must fulfil a number of separate requirements. Thus, it must provide a barrier wall which in the electrolytic cell separates an anode compartment from an adjacent cathode compartment and which thus separates the liquor in the anode compartment from the liquor in the cathode compartment. The bipolar electrode must have an active anode surface on one side of the barrier wall and an active cathode surface on the opposite side of the barrier wall. These active anode surfaces and active cathode surfaces may have a coating of an electroconducting electro-catalytically-active material. It is preferred that the active anode surface, and the active cathode surface, each be displaced from the barrier wall in order to form a space for the anolyte and catholyte liquors between the active anode surface and the barrier wall and between the active cathode surface and the barrier wall respectively. This is particularly desirable when the active anode surface and active cathode surface are close to or in contact with a separator positioned between an anode surface of one bipolar electrode and a cathode surface of an adjacent bipolar electrode. The bipolar electrode must also be provided with means for feeding electrical current from one electrode surface to the other electrode surface across the barrier wall.

There are many forms of such bipolar electrodes.

In GB Patent No. 1503799 there is described a bipolar electrode which comprises a barrier wall made of a titanium plate and an iron plate which plates have been explosion bonded together, a titanium anode displaced from and electrically connected to the titanium plate of the barrier wall, and an iron cathode displaced from and electrically connected to the iron plate of the barrier wall, the iron cathode being displaced from the iron plate of the barrier wall by a distance of at least 10 mm. The electrical connection between the titanium anode and the titanium plate of the barrier wall is provided by a plurality of titanium sheets welded to the anode and to the plate of the barrier wall and positioned vertically therebetween. Similarly, the electrical connection between the iron cathode and the iron plate of the barrier wall is provided by a plurality of iron sheets welded to the cathode and to the plate of the barrier wall and positioned vertically therebetween.

U.S. Pat. No. 3,755,108 describes a bipolar electrolytic cell which comprises a plurality of bipolar units each of which comprises a metallic barrier wall, anodes mounted vertically on one side of the barrier wall, and cathodes mounted vertically on the opposite side of the barrier wall. In the electrolytic cell the bipolar units are so arranged that the anodes of one bipolar unit are interleaved with the cathodes of an adjacent bipolar unit, with a separator, which may be a hydraulically permeable diaphragm or a hydraulically impermeable ion-exchange membrane, positioned between adjacent anodes and cathodes.

Electrolytic cells have widespread applications, and they are used in particular on a large scale throughout the world in the production of chlorine and alkali metal hydroxide, or in the production of alkali metal chlorate or hypochlorite, by the electrolysis of aqueous alkali metal chloride solution.

The electrolytic cell may be of the so-called tank type comprising, for example, a cathode box having a plurality of foraminate cathode fingers with an anode positioned in the gap between adjacent cathode fingers, or it may be of the filter press type and comprise a large number of alternating anodes and cathodes, for example, fifty anodes alternating with fifty cathodes, although the cell may comprise even more anodes and cathodes, for example up to one hundred and fifty alternating anodes and cathodes. The electrode of the present application is particularly suited for use in an electrolytic cell of the filter press type.

Where the electrolytic cell is used in the production of chlorine and alkali metal hydroxide the cell comprises a separator, which may be a hydraulically-permeable microporous diaphragm. Where aqueous alkali metal chloride solution is electrolysed in a cell containing a diaphragm the solution is charged to the anode compartments of the cell and chlorine produced in the electrolysis is removed therefrom, the solution passes through the diaphragm to the cathode compartments of the cell and hydrogen and aqueous alkali metal hydroxide solution produced by electrolysis are removed therefrom.

Where the electrolytic cell contains an essentially hydraulically impermeable cation-exchange membrane aqueous alkali metal chloride solution is charged to the anode compartments of the cell and chlorine produced in the electrolysis and depleted alkali metal chloride solution are removed from the anode compartments, alkali metal ions are transported across the membranes to the cathode compartments of the cell to which water or dilute aqueous alkali metal hydroxide solution may be charged, and hydrogen and alkali metal hydroxide solution produced by the reaction of alkali metal ions with hydroxyl ions are removed from the cathode compartments of the cell.

Electrodes for use in electrolytic cells, including bipolar electrodes, are known which comprise organic plastics material.

U.S. Pat. No. 4,141,801 describes a fuel cell anode electrode made by pressing a paste of noble metal powder, graphite, and polytetrafluoroethylene onto a screen current collector and drying the electrode so formed.

U.S. Pat. No. 3,600,230 describes a gas electrode for use in a gas-depolarising current generating cell which comprises a metallic grid or screen, a porous conductive layer of a hydrophobic resinous material and conductive fibrous material in contact with one surface of the grid or screen, and a catalytically-active layer in contact with the outer surface of the porous conductive layer.

U.S. Pat. No. 4,350,608 describes a cathode formed by compressing a mixture of carbon black and polytetrafluoroethylene optionally onto a core of a metal mesh.

UK Patent application No. 2039954A describes a bipolar current collector which consists of a moulded aggregate of graphite and thermoplastic fluoropolymer.

The present invention relates to an electrode for use in an electrolytic cell which comprises a wall of an organic plastics material. The electrode of the invention is readily produced and, because it comprises a wall of a plastics material, it can readily be sealed by plastics processing techniques to a wall of an adjacent electrode, or to a frame-like gasket of a plastics material positioned between adjacent electrodes. Such techniques cannot, of course, be used to seal together adjacent electrodes of the types hereinbefore described which consist of a wall of metal or metals, for example, as in the electrodes described in GB Patent No. 1503799 and in U.S. Pat. No. 3,755,108. Furthermore, and unlike the electrodes consisting of a metal or metals hereinbefore described, the wall of plastics material is of light weight and may have some flexibility which also aids in sealing to a wall of an adjacent electrode, or to a gasket of a plastics material positioned between adjacent electrodes.

The present invention provides an electrode which comprises a wall of plastics material, an electrically-conductive electrode surface on one side of the wall and displaced therefrom, an electrically-conductive electrode surface on the opposite side of the wall and displaced therefrom, at least one electrically-conductive connecting member in electrical contact with one of the electrode surfaces, at least one electrically-conductive connecting member in electrical contact with the other of the electrode surfaces, and in which the electrically-conductive connecting members are embedded in the wall of plastics material and are in electrical contact with each other.

Although use of the electrode in an electrolytic cell for the production of chlorine and aqueous alkali metal hydroxide solution by the electrolysis of aqueous alkali metal chloride solution has been described it is to be understood that the electrode is not limited to use in an electrolytic cell for such electrolysis. By suitable choice of materials, and in particular of the wall of plastics material and of the electrode surfaces, it may be used in an electrolytic cell in which many different types of electrolyses may be effected.

The electrode of the invention may be a monopolar electrode or a bipolar electrode.

Where the electrode is a monopolar electrode it may be an anode or a cathode and should be provided with means of feeding electrical current to the electrode. The monopolar electrode, when installed in an electrolytic cell, should permit passage of liquid from one side of the wall of plastics material to the other, and in order to permit such passage of liquor the wall may be perforated.

Where the electrode is a bipolar electrode the wall of plastics material should serve as a barrier wall which prevents passage of liquor from one side of the wall to the other, that is from an anode compartment on one side of the wall to a cathode compartment on the other side of the wall. In a bipolar electrode the electrode surface on one side of the wall serves as an anode and the electrode surface on the opposite side of the wall serves as a cathode.

The invention also provides an electrolytic cell which comprises a plurality of electrodes as hereinbefore described. Where the electrode is a monopolar electrode the electrodes serve as anodes and cathodes, and optionally a separator may be positioned between each anode and adjacent cathode. Where the electrode is a bipolar electrode a separator may optionally be positioned between adjacent electrodes, that is between an anode of one bipolar electrode and a cathode of an adjacent bipolar electrode. The electrolytic cell will be provided with means for charging electrolyte to the electrolytic cell and with means for removing products of electrolysis from the electrolytic cell.

The wall of the electrode is of a plastic material which will generally be electrically non-conductive. The wall is suitably in the form of a sheet of plastics material.

There is no particularly preferred thickness for the wall. It should of course be sufficiently thick as to provide a degree of structural integrity and, in the case of a bipolar electrode, to act as a barrier between the liquors on opposite sides of the wall. However, there is no particular advantage to be gained by having a thick wall, and in general a thickness in the range 0.2 cm to 2 cm will suffice, although these thicknesses are not to be taken as being in any way limiting. The wall is suitably flexible and preferably resilient as this aids in forming leak-tight seals when the electrode is installed in an electrolytic cell.

Unless the context dictates otherwise the anode surface and the cathode surface will hereafter be referred to as the electrode surfaces.

The electrode surfaces, which are electrically conductive and will generally be of metal, may take various forms. They may be non-porous, e.g. in the form of a non-porous sheet, but more usually they will be foraminate, e.g. in the form of a foraminate sheet. The foraminate sheet may, for example, be in the form of a perforated plate, e.g. a punched plate, or a mesh, which may be a woven or unwoven mesh, or an expanded substrate, e.g. an expanded metal.

The electrode surfaces of the electrode are each in electrical contact with at least one electrically-conductive connecting member. The purpose of these electrically-conductive connecting members is to conduct current from one electrode surface to the other, for example in a bipolar electrode from the anode surface of the electrode to the cathode surface of the electrode. In order to aid current distribution over the electrode surfaces it is preferred that the electrode surfaces are each in electrical contact with a plurality of electrically-conductive connecting members, which are spaced apart and which are preferably substantially evenly spaced apart.

The electrically-conductive connecting members which are in electrical contact with the electrode surfaces may be in direct or indirect contact with each other. Thus, they may make indirect contact with each other by each being in electrical contact with a separate electrically conducting member, for example a sheet, e.g. a foraminate sheet, which may be of metal, embedded in the wall of plastics material. The use of such an embedded sheet aids in current distribution. In the case of a monopolar electrode the embedded sheet may project beyond the edge of the wall of plastics material and thus provide a means by which electrical current may be fed to the electrode.

The electrode of the invention may take a variety of different forms, and the electrode surface and the electrically-conductive connecting member of the electrode may be of unitary construction or they may be of separate construction and electrically connected to each other.

For example, the electrode surface and the associated electrically-conductive connecting members may be formed of a corrugated sheet, which is suitably foraminate, with the part of the sheet at or near to the peaks of the corrugations projecting from the wall of plastics material and serving as the electrode surface and the part of the sheet at or to near to the troughs of the corrugations serving as the connecting members and being embedded in the wall of plastics material. The corrugations embedded in the wall of plastics material which are electrically connected to an electrode surface on one side of the wall are in electrical contact with the corrugations embedded in the wall which are electrically connected to the electrode surface on the opposite side of the wall. In order to provide a plurality of electrical contacts and to aid current distribution, and particularly where direct electrical contact is established between the corrugations of the sheets, the corrugated sheet providing one electrode surface may be positioned such that the corrugations are transverse to, for example substantially at right angles to, the corrugations of the corrugated sheet providing the opposite electrode surface. The electrode may be constructed by pressing corrugated sheets into the surface of a heat softened sheet of plastics material from opposite sides of the sheet until electrical contact, which may be direct or indirect, is established between the corrugated sheets. The sheet of plastics material may then be allowed to harden.

The corrugated sheet is not necessarily of symmetrical form, or even of substantially symmetrical form. For example, it may be unsymmetrical in that those parts of the corrugated sheet at or near the peaks thereof which project from the wall of plastics material and which serve as the electrode surface may cover a relatively large area, and may be flat, and those parts of the corrugated sheet at or near the troughs thereof which are embedded in the wall of plastics material and which serve as the electrically-conductive connecting members may cover a relatively small area.

In another embodiment of the electrode of the invention the electrode surfaces comprise sheets, which are preferably foraminate and the electrically-conductive connecting members comprise a projection or projections upstanding from the surface of each sheet. The sheet preferably comprises a plurality of such projections on each sheet. The electrode may be constructed by pressing the projections attached to the sheets into the surface of a heat-softened sheet of plastics material from opposite sides thereof until electrical contact, which may be direct or indirect, is established between the projections. In a preferred embodiment, which assists in obtaining good electrical contact between the projections embedded in the wall of plastics material, the wall of plastics material comprises an aperture or a plurality of apertures therein, and the electrode is constructed by positioning the projections attached to the electrode surfaces through the apertures and in contact with each other and sealing the projections to each other, e.g. by welding. The apertures in the wall are then sealed, e.g. by application of a plug of heat-softened plastics material, in order to maintain the electrode surfaces in the desired position relative to the wall of plastics material, and in the case of a bipolar electrode, in order that the wall may function as a barrier wall.

In the foregoing description of embodiments of the electrode of the invention the electrically-conductive connecting members have been described as being of separate construction. However, the electrically-conductive connecting members attached to the electrode surfaces on opposite sides of the wall of plastics material may be of unitary construction. For example, the preferred embodiment of electrode previously described in which the wall comprises an aperture, or a plurality of apertures therein, and the electrode is constructed by positioning the projections attached to the electrode surfaces through the apertures and in contact with each other and sealing the projections to each other, e.g. by welding, may be constructed by positioning the projections attached to one of the electrode surfaces through the apertures in the barrier wall and sealing the projections into electrical contact with the opposite electrode surface, e.g. by welding. In this case the electrically-conductive connecting members attached originally to one electrode surface serve as the connecting members between the electrode surfaces.

The electrically-conductive electrode surfaces are displaced from the wall of plastics material. The amount of this displacement may be small, for example, such that the electrode surfaces are merely slightly upstanding from the surface of the wall. However, it is preferred that the electrode surfaces be displaced so as to leave a gap between the electrode surfaces and the wall which gap provides a space which serves as an electrode compartment. This is particularly necessary where the electrolytic cell comprises a separator which is near to or in contact with the anode and cathode surfaces of adjacent electrodes. The electrode surfaces may be displaced from the wall of plastics material by a distance of, for example 2 mm to 20 mm, although these specific displacements are not intended to be limiting.

In a preferred embodiment the projected area of the electrode surface is less than the projected area of the wall of plastics material such that, for example, in plan view the wall forms a frame-like section around the electrode surface. In the electrolytic cell frame-like gaskets, e.g. of plastics material, may be positioned on this frame-like part of the wall and surround the electrode surfaces. Alternatively, the wall of plastics material of the electrode and the gaskets may be of unitary construction in that the wall may have a greater thickness in the region of the frame-like part than in the part adjacent to the electrode surfaces. The frame-like part of the wall may extend to the plane of the electrode surfaces or extend beyond the plane of the electrode surfaces.

The wall of plastics material may be of a thermoplastic material, or of a thermosetting material, the nature of the material depending at least in part on the type of electrolysis which is to be effected in the electrolytic cell. The plastics material may be, for example, a polyolefin, e.g. polyethylene or polypropylene. It may be an aromatic polymer, e.g. polystyrene, or a polymer containing such aromatic groups, e.g. an acrylonitrile-butadiene-styrene polymer. It may be a halogenated polymer, for example a chlorine-containing polymer, e.g. polyvinyl chloride or chlorinated polyvinyl chloride, or a fluorine-containing polymer, e.g. polyvinyl fluoride, polyvinylidene fluoride, or polytetrafluoroethylene. The plastics material may be an elastomer, for example, polybutadiene, polyisoprene, polychloroprene, an ethylene-propylene copolymer, an ethylene-propylenediene copolymer, or an acrylonitrile-butadiene-styrene polymer as hereinbefore described.

Where the liquors in the electrolytic cell are particularly corrosive, for example in a cell for the electrolysis of aqueous alkali metal chloride solution, corrosion resistant plastics materials are preferred, for example, fluorine-containing plastics materials or plastics materials faced with or filled with such fluorine-containing materials.

Examples of thermosetting plastics materials include polyester resins and epoxy resins.

The electrically-conducting electrode surfaces will generally be metallic, the nature of the metal depending on the type of electrolysis which is to be effected in the electrolytic cell. Where aqueous alkali metal chloride solution is to be electolysed and the electrode surface is to function as an anode surface it is suitably made of, or at least has an active area of, a film forming metal or alloy, for example of zirconium, niobium, tungsten or tantalum. The anode surface preferably has at least an active area of titanium, and the anode surface suitably carries a coating of an electroconducting electrocatalytically-active material. The coating may comprise one or more platinum group metals, that is platinum, rhodium, iridium, ruthenium, osmium or palladium, and/or an oxide of one or more of these metals. The coating of platinum group metal and/or oxide may be present in admixture with one or more film-forming metal oxides, e.g. titanium dioxide, preferably in the form of a solid solution. Electroconducting electrocatalytically-active materials for use as anode coatings in an electrolytic cell for the electrolysis of aqueous alkali metal chloride solution, and methods of application of such coatings, are well known in the art.

Where aqueous alkali metal chemical solution is to be electrolysed and the electrode surface is to function as a cathode the cathode surface is suitably made of, or at least has an active area of iron or steel or other suitable metal, e.g. nickel. The cathode surface may carry a coating of an electroconducting electrocatalytically-active material, e.g. a platinum group metal and/or oxide thereof, which lowers the hydrogen overvoltage of the cathode surface.

The electrolytic cell may be of the diaphragm or membrane type. In the diaphragm type cell the separator positioned between an anode and an adjacent cathode, or between an anode surface of a bipolar electrode and a cathode surface of adjacent bipolar electrode, to form separate anode compartments and cathode compartments in the cell are microporous and in use the electrolyte passes through the diaphragm from the anode compartments to the cathode compartments. Thus, in the case where aqueous alkali metal chloride solution is electrolysed the cell liquor which is produced comprises an aqueous solution of alkali metal chloride and alkali metal hydroxide. In the membrane type electrolytic cell the separators are essentially hydraulically impermeable and in use ionic species are transported across the membranes between the compartments of the cell. Thus, where the membrane is a cation-exchange membrane cations are transported across the membrane, and in the case where aqueous alkali metal chloride solution is electrolysed the cell liquor comprises and aqueous solution of alkali metal hydroxide.

Where the separator to be used in the electrolytic cell is a microporous diaphragm the nature of the diaphragm will depend on the nature of the electrolyte which is to be electrolysed in the cell. The diaphragm should be resistant to degradation by the electrolyte and by the products of electrolysis and, where an aqueous solution of alkali metal chloride is to be electrolysed, the diaphragm is suitably made of a fluorine-containing polymeric material as such materials are generally resistant to degradation by the chlorine and alkali metal hydroxide solution produced in the electrolysis. Preferably, the microporous diaphragm is made of polytetrafluoroethylene, although other materials which may be used include, for example, tetrafluoroethylene-hexafluoropropylene copolymers, vinylidene fluoride polymers and copolymers, and fluorinated ethylene-propylene copolymers.

Suitable microporous diaphragms are those described, for example, in UK Patent No. 1503915 in which there is described a microporous diaphragm of polytetra-fluoroethylene having a microstructure of nodes interconnected by fibrils, and in UK Patent No. 1081046 in which there is described a microporous diaphragm produced by extracting a particulate filler from a sheet of polytetrafluoroethylene. Other suitable microporous diaphragms are described in the art.

Where the separator to be used in the cell is an ion-exchange membrane the nature of the membrane will also depend on the nature of the electrolyte which is to be electrolysed in the cell. The membrane should be resistant to degradation by the electrolyte and by the products of elctrolysis and, where an aqueous solution of alkali metal chloride is to be electrolysed, the membrane is suitably a cation-exchange membrane made of a fluorine-containing polymeric material containing cation-exchange groups, for example, sulphonic acid, carboxylic acid or phosphonic acid groups, or derivatives thereof, or a mixture of two or more such groups.

Suitable cation-exchange membranes are those described, for example, in UK Patent Nos. 1184321, 1402920, 1406673, 1455070, 1497748, 1497749, 1518387 and 1531068.

The separators may be mounted on suitably shaped plates, which may act as sealing gaskets, positioned between adjacent electrodes, or alternatively the separators may merely be held in position by clamping between adjacent electrodes.

The electrolytic cell may contain gaskets, which may be of the same plastics material as the wall of the electrode, or which may be of a different plastics material. The gaskets are preferably pliable and more preferably resilient.

In assembling the electrolytic cell the component parts may be positioned on tie rods and clamped together, or they may be sealed together, e.g. by use of adhesives or by use of thermal welding, in the case where the plastics material is capable of being thermally welded.

The anode compartments of the electrolytic cell are provided with means for feeding electrolyte to the anode compartments, and with means for removing products of electrolysis from the anode compartments. Similarly, the cathode compartments of the electrolytic cell are provided with means for removing products of electrolysis from the cathode compartments, and optionally with means for feeding water or other fluid to the cathode compartments.

For example, where the electrolytic cell is to be used in the electrolysis of aqueous alkali metal chloride solution the anode compartments are provided with means for feeding the aqueous alkali metal chloride solution thereto and with means for removing chlorine and optionally with means for removing depleted aqueous alkali metal chloride solution therefrom, and the cathode compartments are provided with means for removing hydrogen and cell liquor containing alkali metal hydroxide therefrom, and optionally, and if necessary, with means for feeding water or other fluids thereto. Although such means may be provided by separate pipes leading to or from each of the respective compartments such an arrangement would be unnecessarily complicated and cumbersome, and in a preferred embodiment of the electrolytic cell the wall of plastics material of the electrode, and of the separate gaskets, if present, comprises a plurality of openings, e.g. in a frame-like part thereof, which in the electrolytic cell define a plurality of compartments lengthwise of the cell which serve as headers from which, and to which, liquors may be passed. The liquors may be distributed from the headers to the electrode compartments, and to the headers from the electrode compartments, by means of channels, e.g. slots, appropriately positioned in the wall of the plastics material of the electrode and/or in the gaskets, if present.

Figure 2:
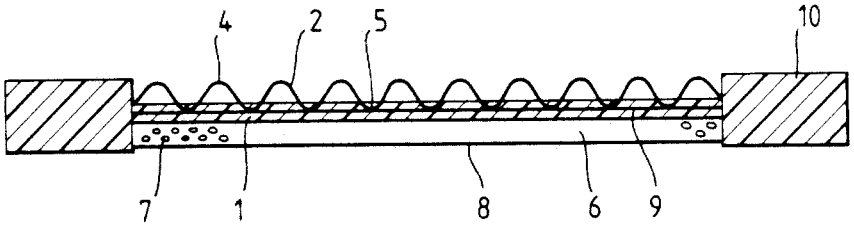
Figure 3:
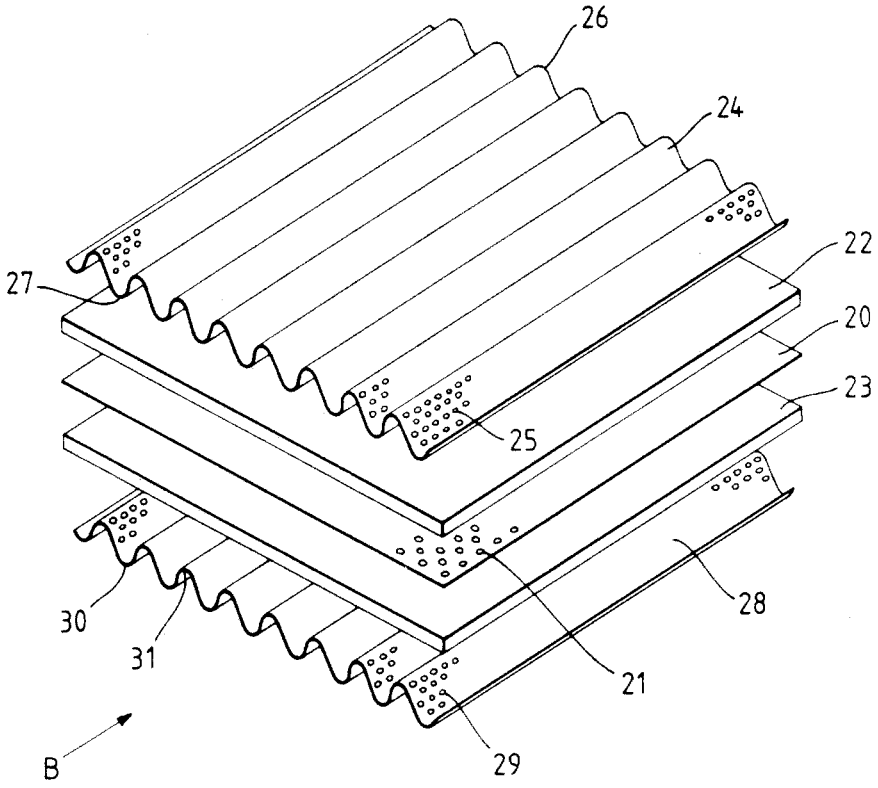
Figure 4:
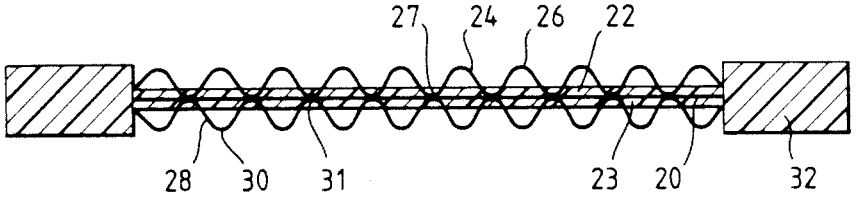
Figure 5:
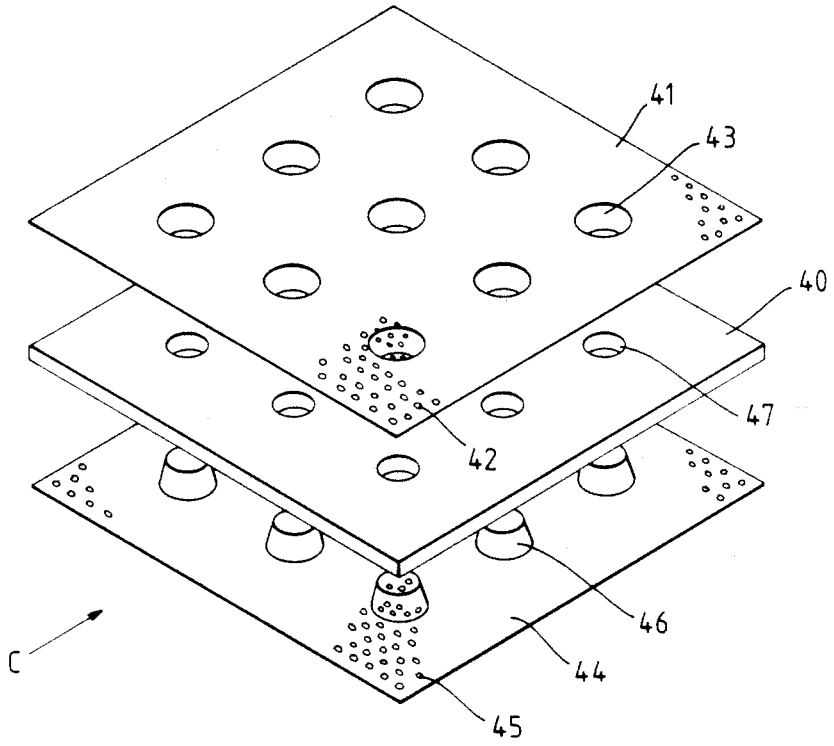
Figure 6:
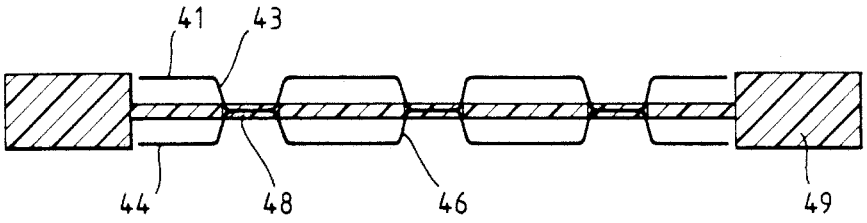
Figure 7:
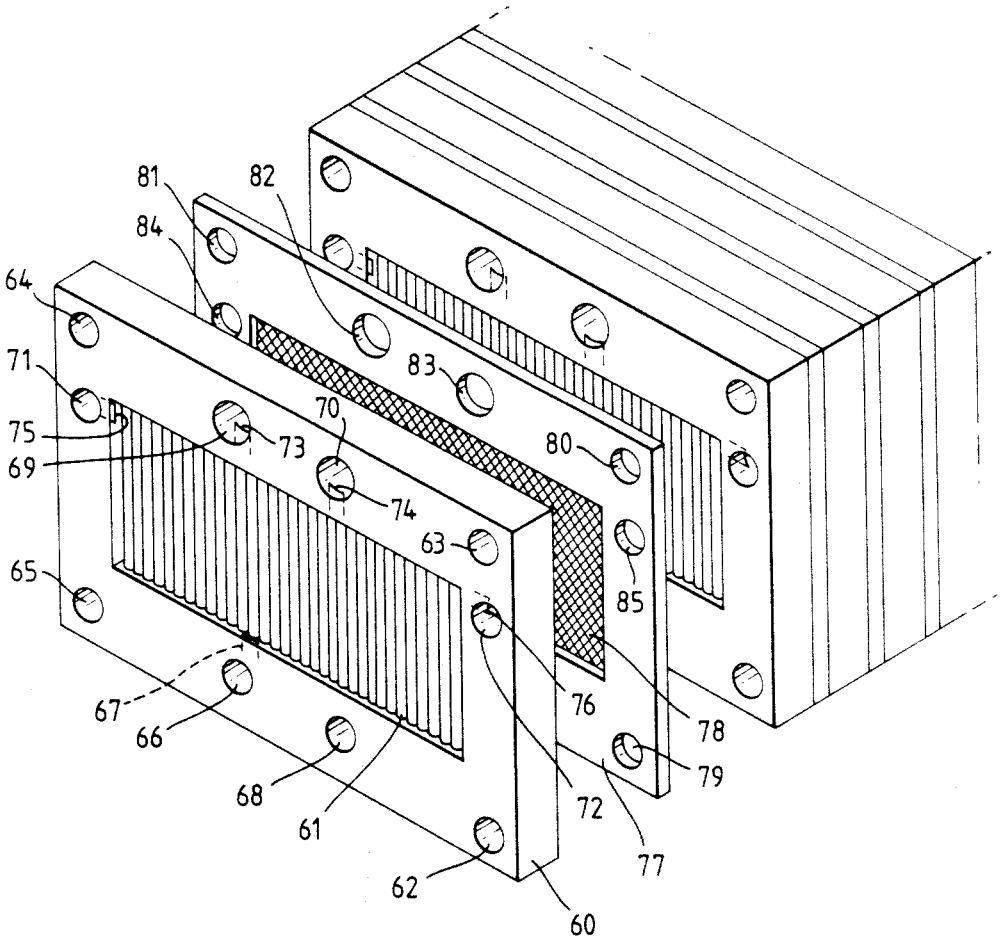

The invention will now be described with the aid of the following figures in which FIG. 1 is an isometric exploded view of a bipolar electrode of the invention, FIG. 2 is an end view in the direction A of the bipolar electrode of FIG. 1, FIG. 3 is an isometric exploded view of a bipolar electrode of the invention, FIG. 4 is an end view in the direction B of the bipolar electrode of FIG. 3, FIG. 5 is an isometric exploded view of a bipolar electrode of the invention, FIG. 6 is an end view in the direction C of the bipolar electrode of FIG. 5, and FIG. 7 is an isometric partially exploded view of an electrolytic cell incorporating the bipolar electrode of FIG. 4.

Referring to FIGS. 1 and 2 the bipolar electrode comprises a sheet 1 of thermoplastic material which serves as a barrier wall in the electrode, a first corrugated metallic sheet 2 having perforations 3, the peaks 4 of which serve as an electrode surface and the troughs 5 of which serve as electrically conductive connecting members, and a second corrugated metallic sheet 6 having perforations 7, the corrugations of sheet 6 being positioned at right angles to those of the sheet 2, and the peaks 8 of which serve as an electrode surface and the troughs 9 of which serve as electrically-conductive connecting members.

The bipolar electrode was assembled by heat softening the sheet of thermoplastics material 1 and pressing the corrugated metallic sheets 2 and 6 into the heat-softened sheet 1 until the troughs 5 of sheet 2 and the troughs 9 of sheet 6 contact each other thereby forming the required electrical connections. As the corrugations of corrugated sheet 2 are positioned at right angles to those of the corrugated sheet 6 a plurality of electrical connections are formed. Finally, the sheet of thermoplastics material 1 was sealed, by heat sealing, to a frame-like member 10 of the same thermoplastics material, the frame-like member 10, which is not shown in FIG. 3, projecting from the plane of the sheet 1 up to the planes of the peaks 4 and 8 of the corrugations of the corrugated metallic sheets 2 and 6 respectively.

Referring to FIGS. 3 and 4 the bipolar electrode comprises a metallic sheet 20 having perforations 21 sandwiched between sheets 22 and 23 of thermoplastics material. The sheets 20, 21 and 23 serve as a barrier wall in the bipolar electrode. The electrode also comprises a first corrugated metallic sheet 24 having perforations 25, the peaks 26 of which serve as an electrode surface and the troughs 27 of which serve as electrically conductive connecting members, and a second corrugated metallic sheet 28 having perforations 29, the peaks 30 of which serve as an electrode surface and the troughs 31 of which serve as electrically-conductive connecting members.

The bipolar electrode was assembled by heat softening the sheets of thermoplastics material 22 and 23 and sandwiching the metallic sheet 20 between the sheets 22 and 23, and pressing the corrugated sheets 24 and 28 into the heat softened sheets 22 and 23 respectively until the troughs 27 of sheet 24 and the troughs 31 of sheet 28 contact the sheet 20 thereby forming the required electrical connections. Finally, the sheets of thermoplastics material 22 and 23 were sealed, by heat sealing, to a frame-like member 32 of the same thermoplastics material, the frame-like member 32, which is not shown in FIG. 3, projecting from the plane of the sheets 22 and 23 up to the planes of the peaks 26 and 30 of the corrugations of the corrugated metallic sheets 24 and 28 respectively.

Referring to FIGS. 5 and 6 the bipolar electrode comprises a sheet 40 of thermoplastics material, a metallic sheet 41 having perforations 42, and projections 43 on one face of the sheet 41, and a metallic sheet 44 having perforations 45, and projections 46 on one face of the sheet 44. Prior to assembly of the electrode the sheet 40 comprises openings 47.

The bipolar electrode was assembled by placing the projections 43 of metallic sheet 41 through the openings 47 in sheet 40 and sealing the projections 43 to the projections 46 on metallic sheet 44, e.g. by welding or by brazing. The openings 47 were then sealed by placing a plug 48 of thermoplastics material in each of the openings 47 in order that the sheet 40 may form a barrier wall in the bipolar electrode. Finally, the sheet of thermoplastics material 40 was sealed, by heat sealing, to a frame-like member 49 of the same thermoplastics material, the frame-like member 49, which is not shown in FIG. 5, projecting from the plane of the sheet 40 up to the planes of the sheets 41 and 44 respectively.

In the electrolytic cell one of the metallic sheets of the bipolar electrode will serve as an anode and the other as a cathode and the surface of each sheet may have a coating of a suitable electrocatalytically-active electroconducting material. Titanium is a suitable metal for an anode sheet and nickel is a suitable metal for a cathode sheet.

In the embodiment illustrated in FIG. 7 the bipolar electrode in the electrolytic cell is of the type described with reference to FIGS. 3 and 4.

The electrolytic cell comprises a frame-like member 60 of an acrylonitrile-butadiene-styrene polymeric material (ABS) having a central opening in which a bipolar electrode 61 is positioned.

The frame-like member 60 has four openings 62, 63, 64, 65 which serve as locations for tie rods used in assembly of the electrolytic cell, as hereinafter described.

The frame-like member 60 comprises a horizontally disposed opening 66 through the thickness of the frame-like member 60 and a vertically disposed channel 67 which leads from the opening 66 to one face of the bipolar electrode 61, and a horizontally disposed opening 68 through the thickness of the frame-like member 60 and a vertically disposed channel (not shown) which leads from the opening 68 to the opposite face of the bipolar electrode 61.

Similarly, the frame-like member 60 comprises four horizontally disposed openings 69, 70, 71, 72 through the thickness of the frame-like member 60 and four channels 73, 74, 75, 76 respectively associated with said openings, the channels 74, 75 leading from one face of the bipolar electrode 61 to the openings 70, 71 respectively, and the channels 73, 76 leading from the opposite face of the bipolar electrode 61 to the openings 69, 72 respectively.

The electrolytic cell also comprises a frame-like member 77 of ABS polymeric material having a central opening in which a cation-exchange membrane 78 is positioned. The membrane is slightly larger than the central opening in the frame-like member 77 and may be affixed thereto by means of an adhesive. Alternatively, the membrane 78 may be sandwiched between a pair of frame-like sections which are bonded together to form the frame-like member 77. The frame-like member 77 comprises four openings 79, 80, 81 (one not shown), corresponding in position to the openings 62, 63, 64, 65 in the frame-like member 60 and which serve as locations for tie rods used in assembly of the electrolytic cell, and six horizontally disposed openings 82, 83, 84, 85 (two not shown) corresponding in position to the openings 69, 70, 71, 72, 66 and 68 in the frame-like member 60.

In assembling the electrolytic cell a frame-like member 60 is positioned on four tie tods through the openings 62, 63, 64, 65 and a face of the member 60 is coated with an adhesive comprising ABS polymeric material in an organic solvent, e.g. perchlorethylene. A frame-like member 77 is then positioned on the tie rods and contacted with the adhesive-coated face of the frame-like member 60. The opposite face of the frame-like member 77 is similarly coated with adhesive and another frame-like member 60 is positioned on the tie rods and contacted with the adhesive coated face of the frame-like member 77. In this way a stack of frame-like members 60 comprising bipolar electrodes 61 and frame-like members 77 comprising cation-exchange membranes is built up, the stack is held in compression until the frame-like members are firmly bonded together, and the tie rods are removed.

In the electrolytic cell the horizontally disposed openings 66, 68, 69, 70, 71, 72 in the frame-like members 60 and the corresponding openings (two not shown) 82, 83, 84 and 85 in the frame-like members 77 together form channels lengthwise of the cell through which, respectively aqueous alkali metal chloride solution may be charged to the anode compartments of the cell, water or dilute aqueous alkali metal hydroxide solution may be charged to the cathode compartment of the cell, hydrogen produced by electrolysis may be removed from the cathode compartments, chlorine produced by electrolysis may be removed from the anode compartments, depleted aqueous alkali metal chloride solution may be removed from the anode compartments, and aqueous alkali metal hydroxide solution produced by electrolysis may be removed from the cathode compartments.

Assembly of the electrolytic cell is completed by sealing end plates (not shown) to each end of the cell, completing electrical connections, and connecting to appropriate headers the channels of which the openings 66, 68, 69, 70, 71, 72 form a part.

In operation in the electrolysis of aqueous alkali metal chloride solution the solution is charged to the anode compartments of the electrolytic cell through the lengthwise channel of which opening 66 forms a part and through vertically disposed channel 67, and depleted alkali metal chloride solution and chlorine produced in the electrolysis are removed from the anode compartments, respectively, through the channel 75 and the lengthwise channel of which opening 71 forms a part, and through channel 74 and the lengthwise channel of which opening 70 forms a part.

Water or dilute alkali metal hydroxide solution is charged to the cathode compartments of the electrolytic cell through the lengthwise channel of which opening 68 forms a part and through a vertically disposed channel (not shown), and alkali metal hydroxide solution and hydrogen produced in the electrolysis are removed from the cathode compartments, respectively, through the channel 76 and the lengthwise channel of which opening 72 forms a part, and through channel 73 and the lengthwise channel of which opening 69 forms a part.

We claim:

1. An electrode which comprises
- a wall of plastics material,
- an electrically-conductive electrode surface on one side of the wall and displaced therefrom,
- an electrically-conductive electrode surface on the opposite side of the wall and displaced therefrom,
- at least one electrically-conductive connecting member in electrical contact at one end thereof with one of the electrode surfaces,
- at least one electrically-conductive connecting member in electrical contact at one end thereof with the other of the electrode surfaces,
- and in which the ends of the electrically-conductive connecting members opposite to the ends thereof which are in electrical contact with the electrode surfaces are embedded in the wall of plastics material and make electrical contact with each other within the wall of plastics material.

2. An electrode as claimed in claim 1 which is monopolar and in which the wall is perforated.

3. An electrode as claimed in claim 1 which is bipolar and in which the wall is a barrier wall.

4. An electrode as claimed in any one of claims 1 to 3 in which the wall is made of an electrically non-conductive plastics material.

5. An electrode as claimed in any one of claims 1 to 4 in which the wall is in the form of a sheet.

6. An electrode as claimed in any one of claims 1 to 5 in which the wall is flexible.

7. An electrode as claimed in any one of claims 1 to 6 in which the electrically-conductive electrode surfaces are metallic.

8. An electrode as claimed in any one of claims 1 to 7 in which the electrode surfaces are foraminate.

9. An electrode as claimed in claim 8 in which the electrode surfaces are foraminate sheets.

10. An electrode as claimed in any one of claims 1 to 9 in which the electrode surfaces are in electrical contact with a plurality of electrically-conductive connecting members.

11. An electrode as claimed in any one of claims 1 to 10 in which the electrically-conductive connecting members are in electrical contact with a metallic sheet embedded in the wall of plastics material.

12. An electrode as claimed in any one of claims 1 to 11 in which the electrode surface and the associated electrically-conductive connecting members are formed of a corrugated sheet.

13. An electrode as claimed in claim 12 in which the corrugations of the corrugated sheet which provides one electrode surface are positioned transverse to the corrugations of the corrugated sheet which provides the opposite electrode surface.

14. An electrode as claimed in claim 13 in which the corrugations of the corrugated sheet which provides one electrode surface are positioned transverse to the corrugations of the corrugated sheet which provides the opposite electrode surface.

15. An electrode as claimed in any one of claims 1 to 11 in which the electrode surface comprises a sheet and the electrically-conductive connecting members comprise a projection or projections upstanding from the surface of the sheet.

16. An electrode as claimed in claim 15 in which the wall of plastics material comprises an aperture or a plurality of apertures therein, and the electrode is constructed by positioning the projections attached to the electrode surfaces in the apertures and in contact with each other, sealing the projections to each other, and sealing the apertures in the wall.

17. An electrode as claimed in any one of claims 1 to 16 in which the projected area of the electrode surface is less than the projected area of the wall of plastics material.

18. An electrode as claimed in claim 17 in which the wall includes a frame-like section around the electrode surface.

19. An electrode as claimed in claim 18 in which the frame-like section of the wall extends at least to the plane of the electrode surface.

20. An electrode as claimed in any one of claims 1 to 16 and 17 to 19 in which the plastics material is a thermoplastic material.

21. An electrode as claimed in any one of claims 1 to 16 and 17 to 20 in which the plastics material is an elastomer.

22. An electrode as claimed in any one of claims 7 to 16 and 17 to 21 in which one of the electrode surfaces is made of a film-forming metal or alloy and the other of the electrode surfaces is made of iron or nickel.

23. An electrolytic cell which comprises a plurality of electrodes as claimed in any one of claims 1 to 16 and 17 to 22.

24. An electrolytic cell as claimed in claim 23 which is a monopolar electrolytic cell, which comprises a plurality of monopolar electrodes as claimed in any one of claims 1, 2, 4 to 16 and 17 to 22, and which comprises a separator positioned between each anode and adjacent cathode.

25. An electrolytic cell as claimed in claim 24 which is a bipolar electrolytic cell, which comprises a plurality of bipolar electrodes as claimed in any one of claims 1, 3 to 16 and 17 to 22, and which comprises a separator positioned between an anode of each bipolar electrode and a cathode of an adjacent bipolar electrode.

* * * * *